US009605871B2

(12) United States Patent
Schultz et al.

(10) Patent No.: US 9,605,871 B2
(45) Date of Patent: Mar. 28, 2017

(54) FURNACE BURNER RADIATION SHIELD

(71) Applicant: Honeywell International Inc., Morristown, NJ (US)

(72) Inventors: Michael William Schultz, Elk River, MN (US); James Holmberg, Camplin, MN (US); Douglas Perry, Muncie, IN (US); Tim J. Smith, Minneapolis, MN (US); Curtis Taylor, Gaston, IN (US)

(73) Assignee: Honeywell International Inc., Morris Plains, NJ (US)

( * ) Notice: Subject to any disclaimer, the term of this patent is extended or adjusted under 35 U.S.C. 154(b) by 648 days.

(21) Appl. No.: 13/950,186

(22) Filed: Jul. 24, 2013

(65) Prior Publication Data

US 2013/0302737 A1 Nov. 14, 2013

Related U.S. Application Data

(63) Continuation-in-part of application No. 13/529,692, filed on Jun. 21, 2012, now Pat. No. 8,919,337, which (Continued)

(51) Int. Cl.
*F24H 3/08* (2006.01)
*F24H 9/02* (2006.01)

(Continued)

(52) U.S. Cl.
CPC ..... *F24H 3/087* (2013.01); *F23C 9/00* (2013.01); *F23D 14/58* (2013.01); *F23D 14/62* (2013.01);

(Continued)

(58) Field of Classification Search
CPC ..... F24H 3/087; F24H 9/02; F24H 9/2085; F23M 5/00; F23C 9/00; F23D 14/58;

(Continued)

(56) References Cited

U.S. PATENT DOCUMENTS 3,080,912 A 3/1963 Winter
4,945,890 A 8/1990 Ripka (Continued)

FOREIGN PATENT DOCUMENTS

EP 1006274 8/2003
GB 2349456 1/2000

OTHER PUBLICATIONS

Ebm-papst, Inc., "New Generation of Premix Gas Blowers," 51st Annual International Appliance Technical Conference, 10 pages, May 2000.

(Continued)

*Primary Examiner* — Alfred Basichas
(74) *Attorney, Agent, or Firm* — Seager, Tufte & Wickhem, LLP

(57) ABSTRACT

A burner system for a furnace. The system may have a wedged or other shaped burner box. An air-fuel mixer may be attached to a smaller end of the burner box at virtually any angle relative to a direction of a gas and air mixture leaving the larger box end. A burner head may be attached to the larger end of the box. The burner head may be sufficient for numerous heater sections of a heat exchanger. A spacer and a radiation shield may be situated between the burner head and heat exchanger. An addition of the radiation shield may reduce the operating temperature of the burner box, burner head and/or spacer. A fan may move the gas and air mixture from the mixer, through the box and the burner head. The mixture may be ignited into a flame which is moved into the heat exchanger.

11 Claims, 12 Drawing Sheets

Related U.S. Application Data is a continuation-in-part of application No. 13/399,942, filed on Feb. 17, 2012, now abandoned.

(51) Int. Cl.

| | |
|---|---|
| ***F24H 9/20*** | (2006.01) |
| ***F23M 5/00*** | (2006.01) |
| ***F23C 9/00*** | (2006.01) |
| ***F23D 14/58*** | (2006.01) |
| ***F23D 14/62*** | (2006.01) |
| ***F23D 14/76*** | (2006.01) |
| *F23N 5/18* | (2006.01) |

(52) U.S. Cl.

CPC ..... *F23D 14/76* (2013.01); *F23M 5/00* (2013.01); *F24H 9/02* (2013.01); *F24H 9/2085* (2013.01); *F23D 2212/201* (2013.01); *F23D 2900/00019* (2013.01); *F23N 2005/181* (2013.01); *F23N 2005/185* (2013.01); *F23N 2025/10* (2013.01); *F23N 2025/16* (2013.01); *F23N 2033/08* (2013.01); *F23N 2033/10* (2013.01); *F23N 2035/12* (2013.01)

(58) Field of Classification Search

CPC .... F23D 14/62; F23D 14/76; F23D 2212/201; F23D 2900/00019; F23N 2005/181; F23N 2005/185; F23N 2025/10; F23N 2025/16; F23N 2033/08; F23N 2033/10; F23N 2035/12

See application file for complete search history.

(56) References Cited

U.S. PATENT DOCUMENTS

| | | | |
|---|---|---|---|
| 5,092,761 | A | 3/1992 | Dinicolantonio |
| 5,375,586 | A | 12/1994 | Schumacher et al. |
| 5,379,751 | A | 1/1995 | Larsen et al. |
| 5,439,372 | A | 8/1995 | Duret et al. |
| 5,899,866 | A | 5/1999 | Cyrus et al. |
| 5,997,285 | A | 12/1999 | Carbone et al. |
| 6,004,129 | A | 12/1999 | Carbone et al. |
| 6,062,848 | A | 5/2000 | Lifshits |
| 6,089,221 | A | 7/2000 | Mano et al. |
| 6,190,159 | B1 | 2/2001 | Moore et al. |
| 6,314,949 | B1 | 11/2001 | DeGrazia, Jr. et al. |
| 6,383,462 | B1 | 5/2002 | Lang |
| 6,736,118 | B1 | 5/2004 | Velke |
| 6,758,208 | B2 | 7/2004 | Gierula et al. |
| 6,846,175 | B2 | 1/2005 | Spicer |
| 6,877,980 | B2 | 4/2005 | Stephens et al. |
| 6,880,548 | B2 | 4/2005 | Schultz et al. |
| 6,889,686 | B2 | 5/2005 | Specht |
| 6,923,643 | B2 | 8/2005 | Schultz et al. |
| 6,938,688 | B2 | 9/2005 | Lengauer, Jr. et al. |
| 7,658,183 | B1 | 2/2010 | Johnson |
| 7,726,386 | B2 | 6/2010 | Specht |
| 8,167,610 | B2 | 5/2012 | Raleigh et al. |
| 8,417,091 | B2 | 4/2013 | Kim et al. |
| 8,616,194 | B2 | 12/2013 | Sherrow et al. |
| 8,646,442 | B2 | 2/2014 | Manohar et al. |
| 2005/0194003 | A1 | 9/2005 | Paulsen et al. |
| 2009/0145419 | A1 | 6/2009 | Hoeve |
| 2010/0310998 | A1* | 12/2010 | Raleigh ..... F23D 14/58 431/8 |
| 2011/0073101 | A1 | 3/2011 | Lau et al. |
| 2013/0213378 | A1 | 8/2013 | Schultz |
| 2013/0213379 | A1 | 8/2013 | Schultz et al. |

OTHER PUBLICATIONS

Environmental Protection Agency, "Natural Gas Combustion," 10 pages, Jul. 1998.

http://web.archive.org/web/20101130062956/http://www.thermalloys.com/Eng/TH_FeCrAl.htm, "Thermalloys AB," 1 page, printed Aug. 13, 2013.

* cited by examiner

FURNACE BURNER RADIATION SHIELD

The present application is a continuation-in-part application of U.S. patent application Ser. No. 13/529,692, filed Jun. 21, 2012, and entitled "A Furnace Premix Burner", which is a continuation-in-part of U.S. patent application Ser. No. 13/399,942, filed Feb. 17, 2012, and entitled "A Burner System for a Furnace". U.S. patent application Ser. No. 13/529,692, filed Jun. 21, 2012, is hereby incorporated by reference. U.S. patent application Ser. No. 13/399,942, filed Feb. 17, 2012, is hereby incorporated by reference.

BACKGROUND

The present disclosure pertains to furnaces and particularly to burner systems for furnaces. More particularly, the disclosure pertains to mechanisms that reduce temperatures of the burner systems.

SUMMARY

The disclosure reveals a burner system for a furnace. The system may have a wedged or other shaped burner box. An air-fuel mixer may be attached to a smaller end of the burner box at about an angle which may range from a straight line to a right angle relative to a direction of a gas and air mixture leaving the larger box end. The angle could be greater than a right angle. A burner head may be attached to the larger end of the box. The burner head may be sufficient for numerous heater sections of a heat exchanger. A spacer and a radiation shield may be situated between the burner head and heat exchanger. An addition of the radiation shield may reduce the operating temperature of the burner box, burner head and/or spacer. A fan may push or pull in the gas and air mixture from the mixer, through the box and the burner head. The mixture may be ignited into a flame which is moved into the heat exchanger.

DESCRIPTION

Figure 1:
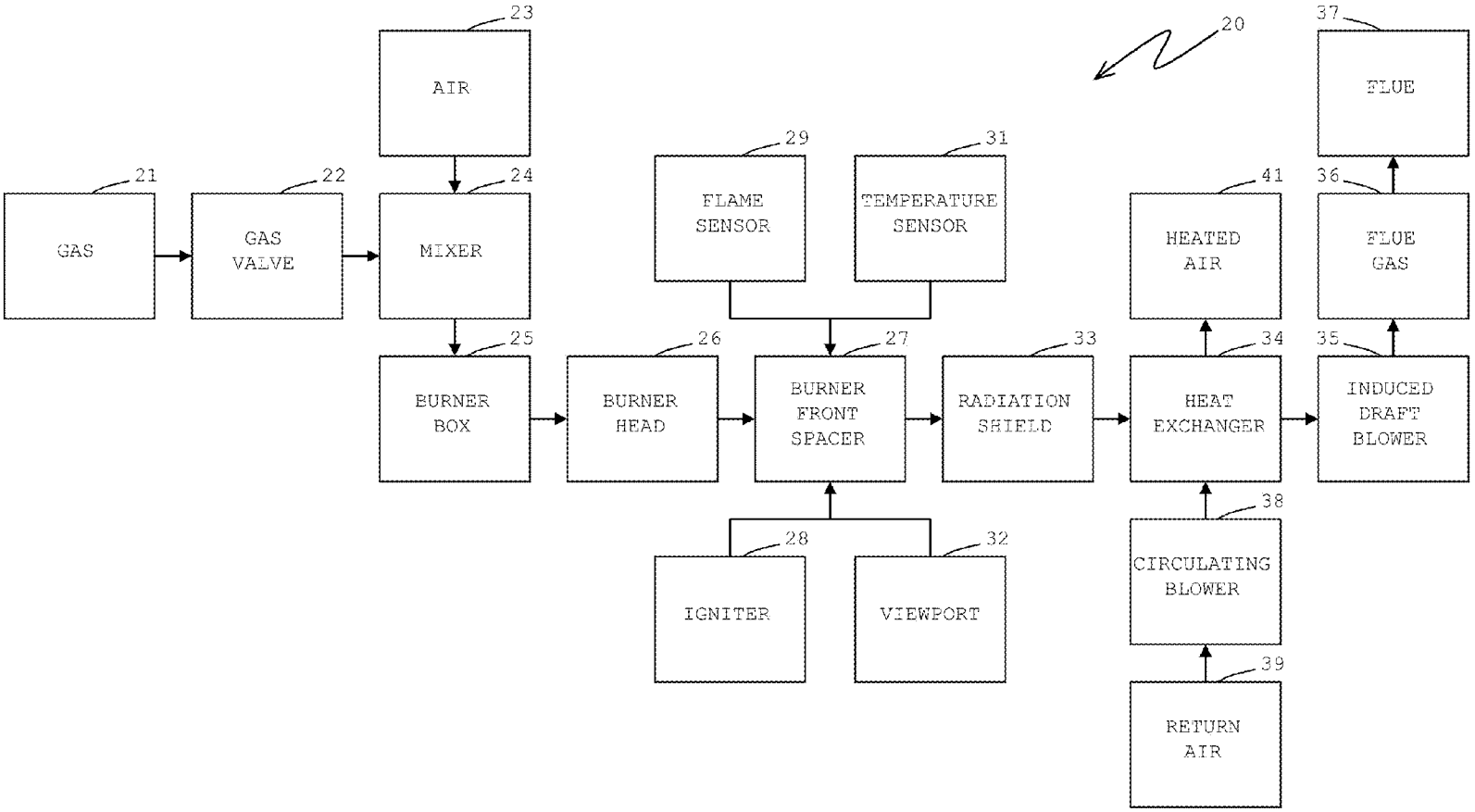
FIG. 1 is a block diagram of a burner system for a heat exchanger.

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

Central furnaces may be typically designed to be used with inshot burners. When premix burners are used in place of inshot burners to obtain reduced NOx emissions, the short premix flames may create a large increase in heat transfer to the center panel of the furnace creating unacceptable surface temperatures. To make matters worse, the high temperatures may be transmitted to the heat exchanger crimps in the center panel reducing functional life. Central furnaces may be constructed with multiple parallel heat exchanger paths that have uneven combustion product flow, uneven heat output and variations in combustion constituents due to unequal inducer fan pressure in the parallel heat exchanger paths.

The present mechanism may resolve the issue of heat transfer to the center panel and heat exchanger crimps. The mechanism may utilize a shield coated with a thermal barrier coating to reduce heat transfer to the center panel and heat exchanger crimps. Fabrication of the present apparatus may involve a computer numerical control or automated approach.

An alternate solution may be a five-sided poured, machined, molded or vacuum formed ceramic fiber combustion chamber with an integral radiation shield and combustion chamber refractory. The exit holes of the radiation shield or combustion chamber may be sized to equalize combustion product flow through the multiple parallel heat exchanger paths.

The radiation shield may be a stamped or machined metal shield that reduces heat transfer from the center panel and heat exchanger crimps of a central furnace. The mechanism may use a thermal barrier coating to reduce heat transfer to the shield and the center panel and heat exchanger crimps. An alternate mechanism may be a five-sided poured, machined, molded or vacuum formed ceramic fiber combustion chamber with integral radiation shield and combustion chamber refractory. Refractory materials may have the properties to retain its physical shape and chemical identity when subjected to high temperatures. A refractory material may retain its strength at high temperatures. Refractory materials may be non-metallic materials having those chemical and physical properties that make them applicable for structures, or as components of systems, that are exposed to environments above 2300 degrees F. (1533 deg. K; 1260 deg. C.). The melting point of such materials may be at least 3000 degrees F. The refractory material maintains its condition from room temperature to least 2300 degrees F. Room temperature may be regarded as 70 degrees F.

There may be various examples that incorporate the disclosed radiation shield. An example of an apparatus may have a premix burner structure constructed with 45 degree angle convolutions. The convolutions may be used to increase surface area resulting power inputs similar to inshot burners. The structure may have other degree convolutions.

The air and fuel may be supplied using a 1:1 gas valve and the mixer. The air/fuel mixture (i.e., premix) may be introduced into a box/manifold to which the burner head is assembled. Flue gases may be recirculated by running a pipe from the flue to the inlet of the mixer. The recirculation may be controlled by an orifice which is sized to provide the correct amount of flue products to achieve the desired emissions. Partition panel temperature may be monitored to insure proper combustion. A high partition panel temperature may indicate high burner CO2 or low flue gas recirculation.

The present approach may incorporate a burner solution designed to bolt onto existing warm air furnace heat exchangers with no modifications to the "hot" side of the furnace. Gas (e.g., natural, LP, butane, or the like) may enter the gas valve. The gas valve may regulate the gas pressure. The mixer may mix gas and air. A gas orifice and an air orifice contained in the mixer may be sized to obtain combustion $CO_2$ ranging from 5 to 8 percent for low NOx emissions and up to 9 percent for increased combustion efficiency.

The gas/air mixture may be admitted into the burner box with a straight alignment or an angle greater than zero relative to the burner head. A choice of alignment may affect a mixing of the gas and air and/or affect the length of the assembly. The burner box may be wedge shaped. The depth and width (aspect ratio) of the burner box may be designed to reduce acoustic resonance of the premix burner. The box does not necessarily have internal features to shape or distribute the gas/air mixture. Large input furnace models may include a baffle inside the burner box to aid in distribution of the gas and air.

The burner head may be a FeCrAl alloy fiber layer, such as a mat, weave, or knit of fibers, strands, wires, or the like. The layer does not necessarily have features to shape or distribute the flame and requires no supporting substrate. The fibers, strands, or wire-like materials may have about a 0.004 inch diameter, but may have other diameters. Other shapes of the layer material may be used. Other materials may incorporate Kanthal™, Fecralloy™, and the like. Even non-metal fibers or wires may be used. The material of fibers, strands, wires and the like should be able to withstand temperatures greater than 1800 degrees F.

Burner design may consist of one burner head for all of the heat exchanger sections as opposed individual burners within or for each heat exchanger section. There may instead be a burner header for each sub-group of sections.

A FeCrAl alloy fiber layer, as an example, may create a very small pressure drop of in the range of 0.05-0.5" WC (water column). Nominal thickness of the layer may range between 0.01 and 0.10. An example thickness may be 0.035". A flame may be shaped by a negative pressure created by an induced draft blower moving the flame and combustion products through the orifice shield and heat exchanger. The burner head may be spaced away from the heat exchanger by a burner front spacer which can also contain the igniter, flame sensor and viewport. The igniter may be a hot surface or direct spark. The direct spark version may use a single rod for ignition and flame sensing. A temperature sensor may be used to detect unsafe or abnormal operating conditions of the burner.

An orifice shield may be in front of the heat exchanger. The orifice shield may prevent overheating the partition panel with flame impingement or radiant energy from the burner. The orifice shield may also help shape the flame.

The primary heat exchanger may be a tube or clamshell construction with multiple parallel paths and with or without a secondary tube and fin heat exchanger. Combustion products may flow inside the heat exchanger, and circulating air may flow over the outside of the heat exchanger. Circulating blower outlet may be turned 180 degrees from a current configuration to direct circulating air flow to the front end of the heat exchanger. The design may or may not necessarily include baffling within the heat exchanger to direct air flow across specified sections of the tube or clamshell.

A summary of additional information may incorporate: 1) Premix burner lighting at approx 50 percent of full rate; 2) Design and application may include control of the inducer fan speed; 3) Burner design may or may not include a fixed or variable firing rate control; 4) Use of an electronic or mechanical choke of the mixer to control the gas/air mixture; 5) Use of a pressure switch to time the point at which gas flows for during the ignition sequence; 6) Solution may or may not utilize a single, two-stage, or modulating atmospheric gas valve or a 1:1 premix gas/air control; 7) Application may or may not include a flue sensing device to determine CO2, burner temperature, or flue temperature to tune the gas/air mixture; 8) Use of a mass flow sensor, for example, Helga trim (i.e., a Honeywell™ electronic gas/air control mass flow sensor) to monitor emissions; 9) Use of a gas valve (e.g., a Honeywell PX42 pneumatic 1:1) in combination with a stepper motor control throttle within the mixer to control gas/air mixture; and 10) Use of an adjustable choke controlling the combustion air of an atmospheric valve application.

The system may also have an addition of flue gas recirculation through a fixed orifice. The orifice may be sized for 5 to 10 percent flue gas recirculation.

FIG. 1 is a diagram of an example burner system 20. It may begin with gas 21, via a gas valve 22, and air 23 to be mixed in a mixer 24, such as for example, a venturi. A gas and air mixture may be moved into a wedged or other shaped burner box 25. The mixture may go from burner box 25 to a burner head 26 and burner front spacer 27 where the mixture is ignited into a flame. There may be an igniter 28 and a flame sensor 29. The igniter 28 may be a hot surface or a direct spark igniter. If it is a direct spark type, then a single rod may be used for both ignition and flame sensing. A temperature sensor 31 may be incorporated for monitoring conditions of the burner. There may be a viewport 32 for observation at the burner front spacer 27.

A radiation shield 33 may be positioned at the front of spacer 27 and at a heat exchanger 34. The flame may be moved into a multiple tube or clamshell structure of the exchanger. The flame may be moved in through the heat exchanger 34 by an induced draft blower 35. Blower 35 may push in or pull out exhaust or flue gas 36 into a flue 37. A circulating blower 38 may push or pull return air 39 and move the air through heat exchanger 34. From heat exchanger 34 may be heated air 41. To move something such as air, a mixture or a flame may, for example, utilize a positive or negative pressure.

Figure 2:
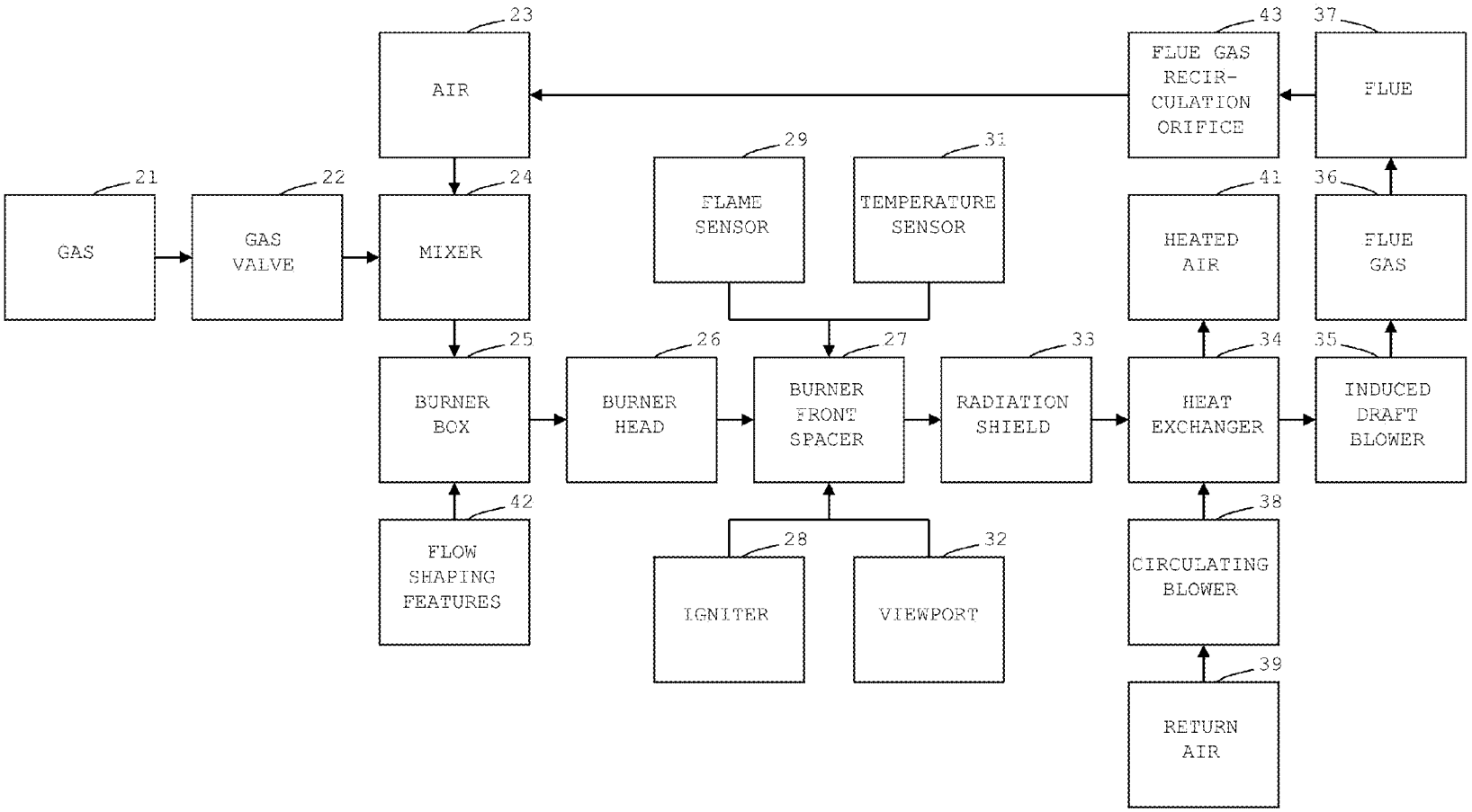
FIG. 2 is a block diagram of the burner system incorporating flue gas recirculation.

FIG. 2 is a diagram that reveals much of the same burner system as shown in the diagram of FIG. 1. One distinctive aspect may incorporate flow shaping features 42 in burner box 25. Features 42 may be not necessary but could be present for a large input furnace model to aid in the distribution of the gas and air. Another distinctive aspect may incorporate recirculation of exhaust gas. Recirculation may involve a flue gas recirculation orifice 43 with appropriate tubing to provide a particular amount of flue gas 36 to be mixed in with air 23 being provided to mixer 24 for mixing with gas 21.

Figure 3:
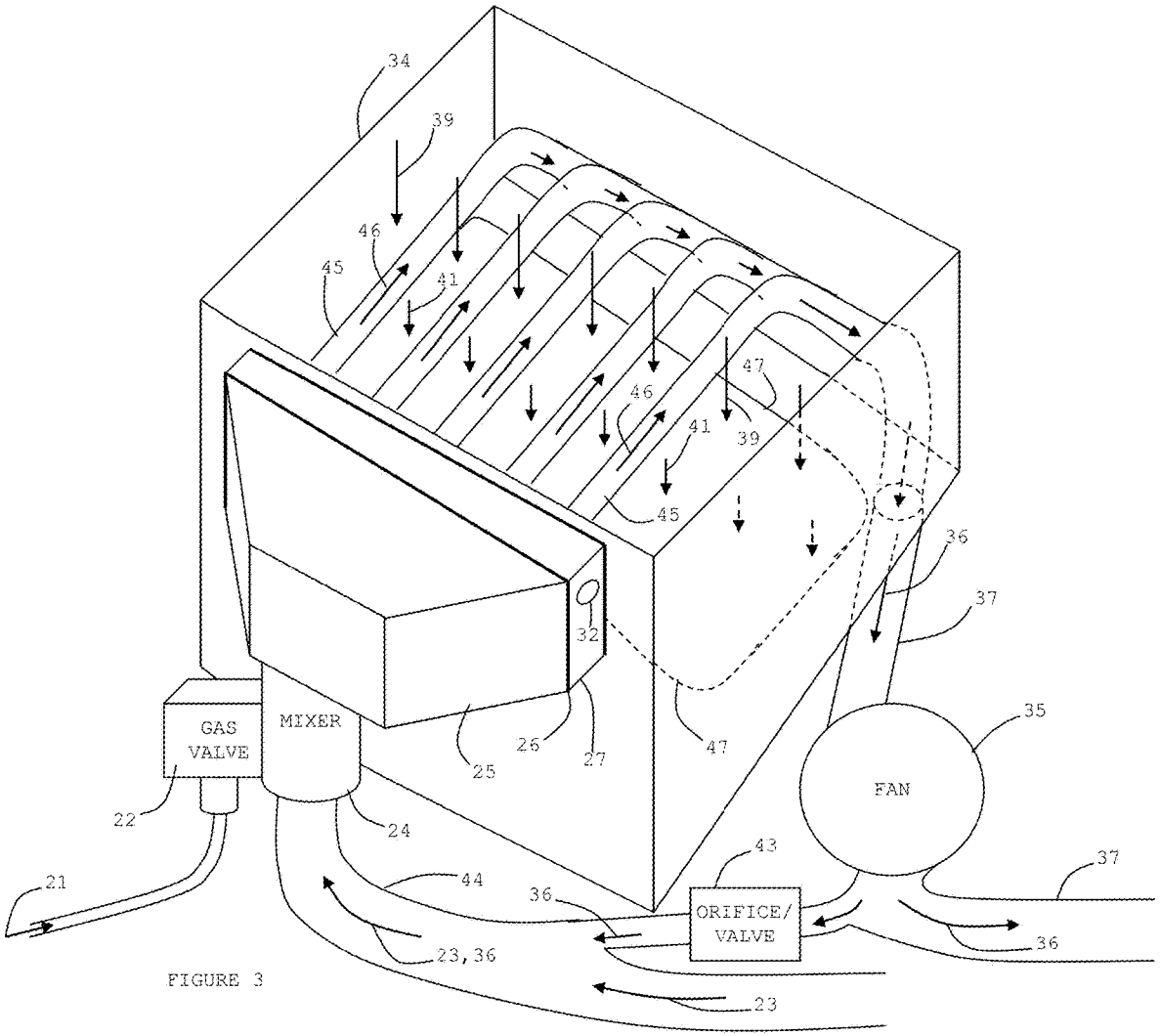
FIG. 3 is a diagram of a burner in conjunction with a heat exchanger.

FIG. 3 is a diagram of a heat exchanger 34 and an associated burner assembly. Air 23 may enter a tube 44. If there is recirculation of flue gas 36, then some flue gas 36, as controlled by orifice or valve 43, may be mixed with air 23 in tube 44. Air 23, with or without flue gas 36, may go to mixer 24 to be mixed with a gas 21 via a gas valve 22.

Figure 5:
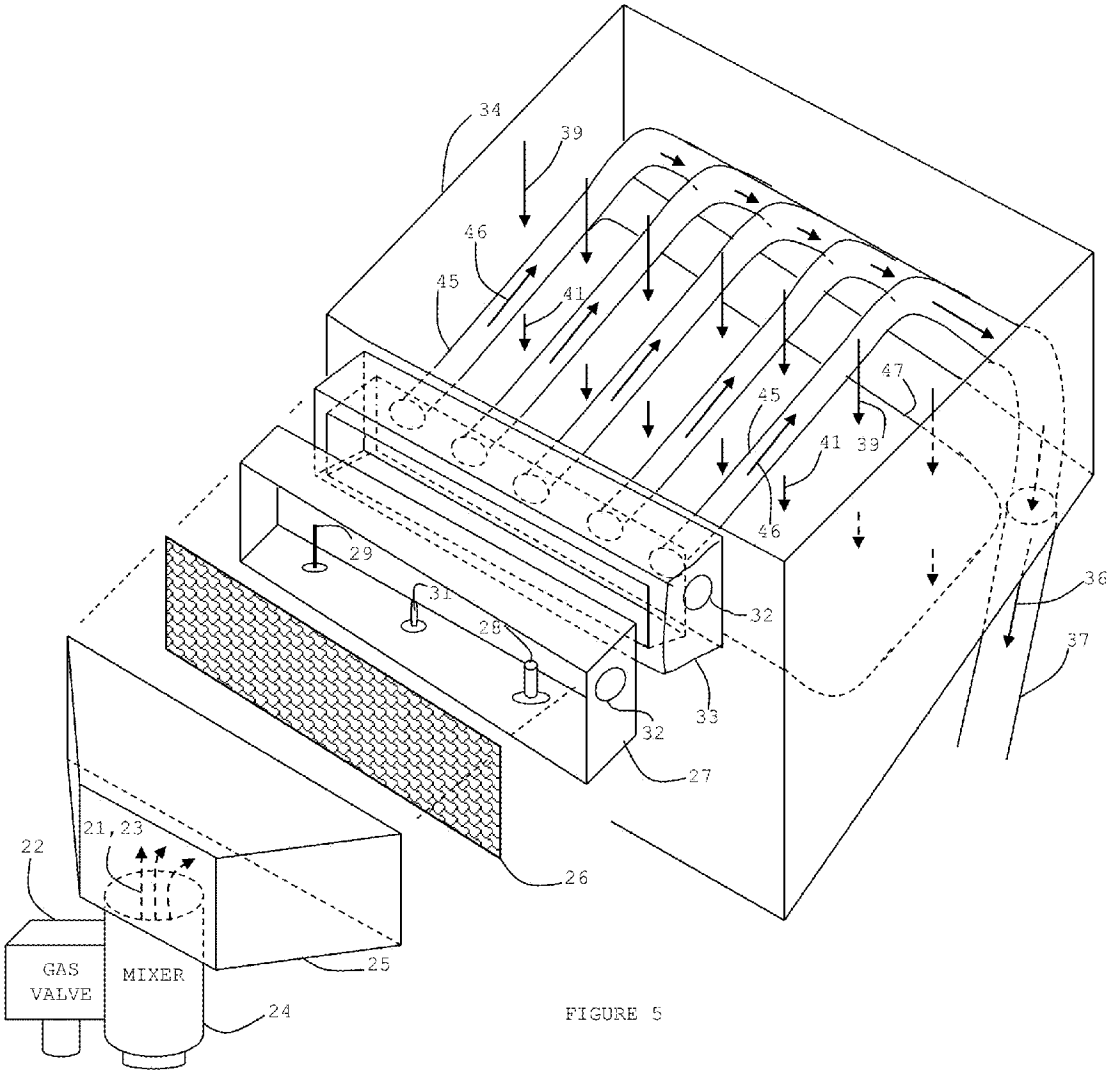
FIG. 5 is a diagram of an expanded view of the burner having a radiation shield between the burner and the heat exchanger.

A gas and air mixture may be moved from the mixer 24 into and through a wedged-shaped box manifold 25. Manifold 25 may have a different shape. The mixture may be moved through a burner head 26, which may be a layer such as a mesh, fiber mat, or woven or knit fibers, after which the mixture can be ignited into a flame. The flame may be moved through a front burner spacer 27 and a radiation shield 33 (FIG. 5). The flame may be further moved in as separate flames 46 through tubes 45 of heat exchanger 34. A circulating blower may move return air 39 by hot tubes 45 to result in heated air 41 which exits the exchange port out of a port 47 to various vents or the like for heating a space or spaces. Flames 46 in tubes 45 may result in burnt gases 36 which are moved through flue 37 by fan 35. Fan 35 may be a blower. Fan 35 may be modulated or varied in speed. Fan 35 may move much flue gas 36 out of the system via flue 37 to the outside. Some of flue gas 36 may be re-circulated with air 23, as noted herein.

Figure 4:
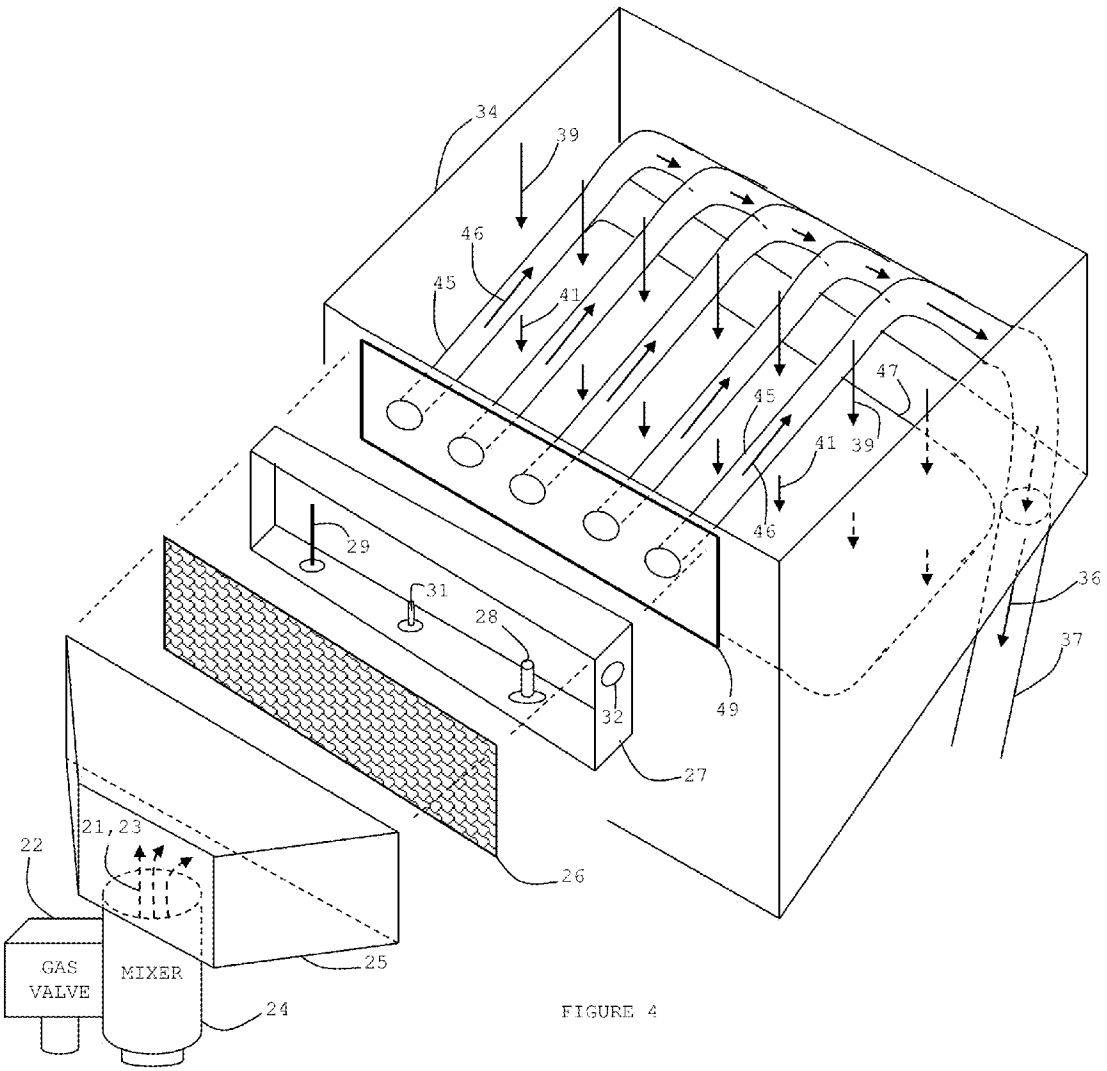
FIG. 4 is a diagram of an expanded view of the burner having an orifice shield between the burner and the heat exchanger.

FIG. 4 is a diagram of burner system like that of FIG. 3 except an expanded view of the burner components is shown. Mixture 21, 23 may be provided by mixer 24 into wedged-shaped box 25. The mixture may turn towards an exit of box 25 and move through burner head 26. Burner head 26 may be a layer such as a mesh, fiber mat, or woven or knit fibers. Once mixture 21, 23 passes through burner head 26, the mixture may be ignited by an igniter 28 in the burner front spacer 27 into a flame 46. Burner front spacer 27 may also have a flame detector 29 and a temperature sensor 31. In some situations, a flame detector 29, with an appropriate structure may also operate as an igniter of mixture 21, 23. The flame may be moved to an orifice shield 49 having holes for flame entry into the respective tubes 45. Individual flames may be moved through tubes 45, for providing heated air 41, as noted herein.

FIG. 5 is a diagram indicating a flow of gas 21, 23 from box 25 to burner head 26, and an ignited flame 46 after burner head 26 moving from spacer 27 to radiation shield 33 and heat exchanger tubes 45. Radiation shield 33 may be situated inside of spacer 27. Radiation shield 33 may replace orifice shield 49. Radiation shield 33 may prevent components such as spacer 27, burner head 26 and burner box 25 from becoming overheated and too hot for trouble-free and efficient operation of the burner assembly and heat exchanger 34. Replacing orifice shield 49 with radiation shield 33 may result in a reduction in temperature of 600 degrees F. at the outside surface of spacer 27 and associated components.

Figure 6:
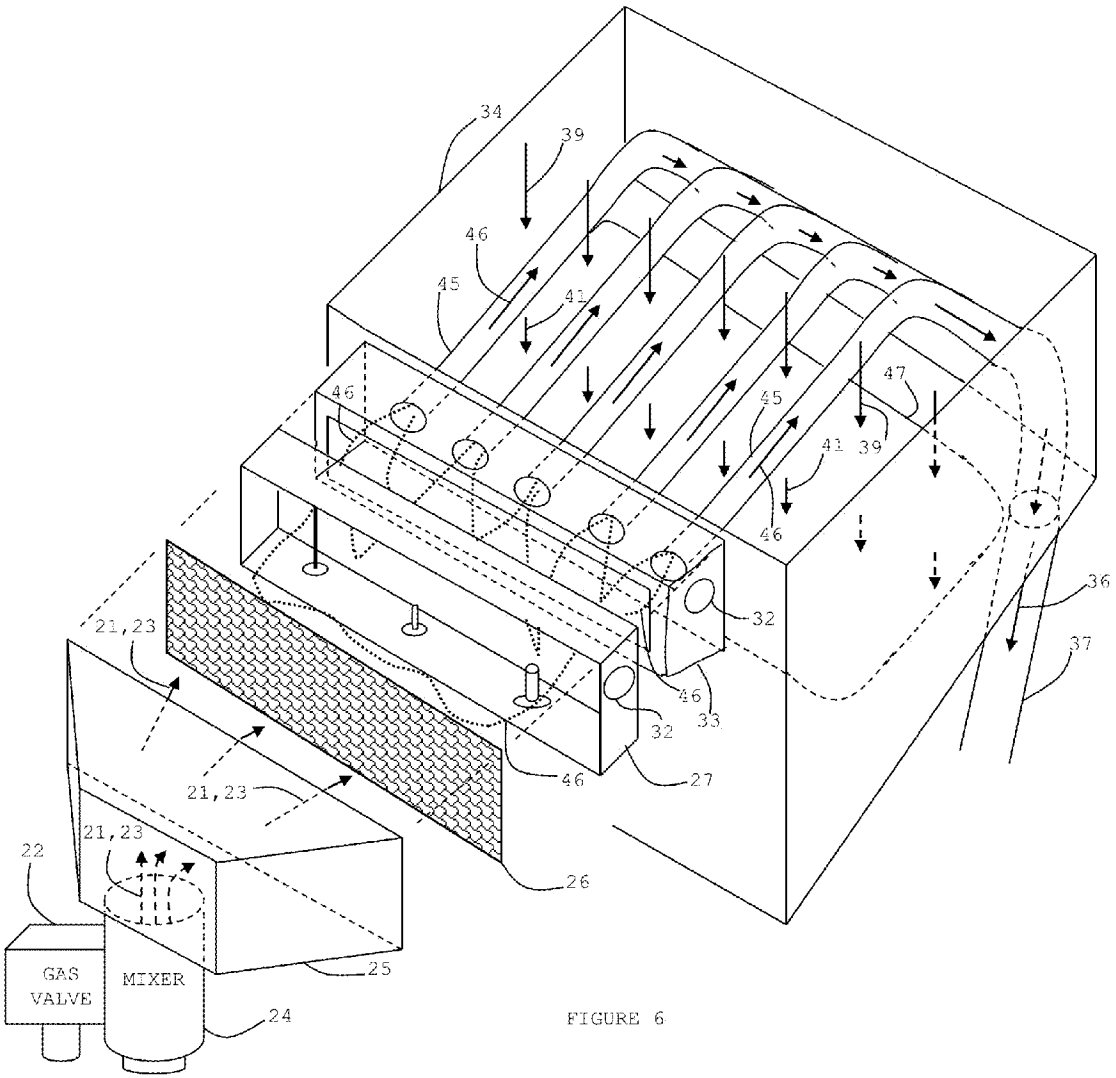
FIG. 6 is a diagram indicating a flow of gas to a burner and an ignited flame after the burner head moving to the radiation shield and the heat exchanger tubes.

FIG. 6 is a diagram of the burner system of FIG. 5 except that the mixture 21, 23 is shown moved through burner head 26 and being ignited into a flame 46. Flame 46 may be moved through spacer 27 and radiation shield 33 to tubes 45 of exchanger 34.

Figure 7:
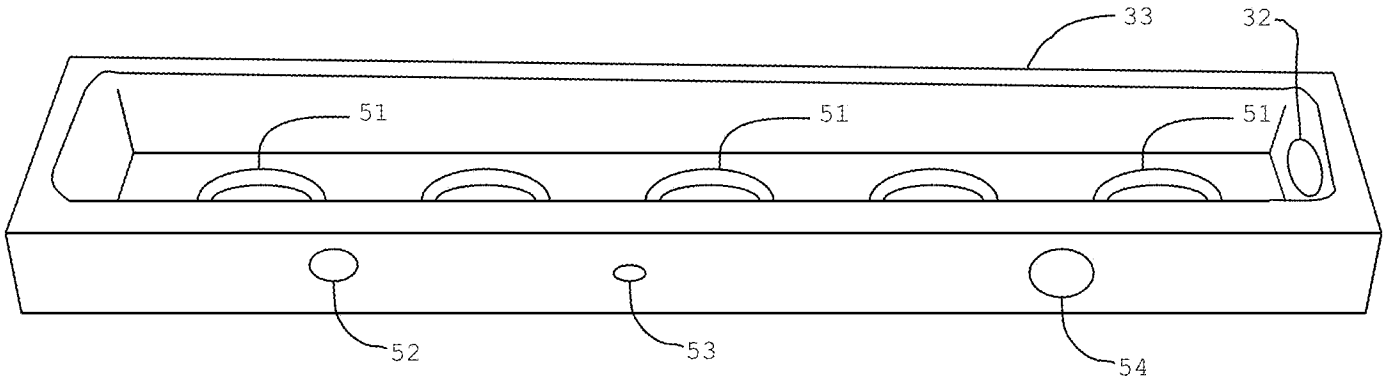
FIG. 7 is a diagram showing a perspective view of an example radiation shield.

FIG. 7 is a diagram showing a perspective view of an example radiation shield 33. Shield 33 may have holes 51 that match up on a one to one basis to connect with tubes 45 of heat exchange 34. At one side of shield 33 are holes 52, 53 and 54, respectively, for placement or insertion of flame sensor 29, temperature sensor 31 and igniter 28 shown in FIG. 5. On one side is a hole 32 which may be used as a site window for observing flame 46 in shield 33.

Figure 8:
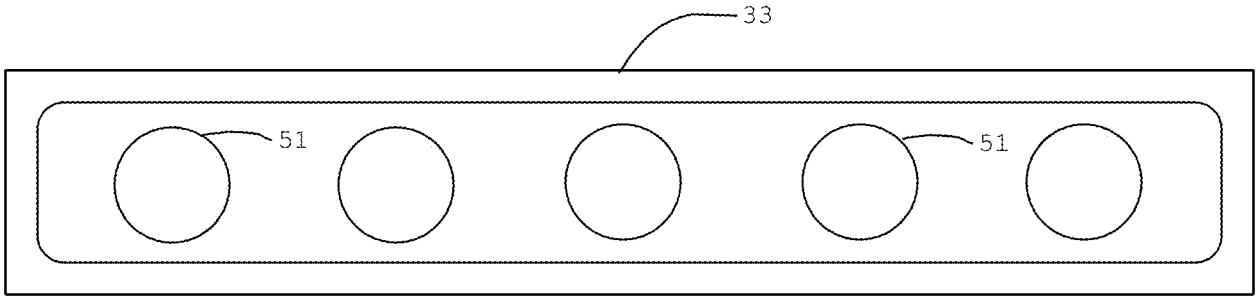
FIG. 8 is a diagram of a front end of the radiation shield revealing holes for connection to a heat exchanger.
Figure 9:
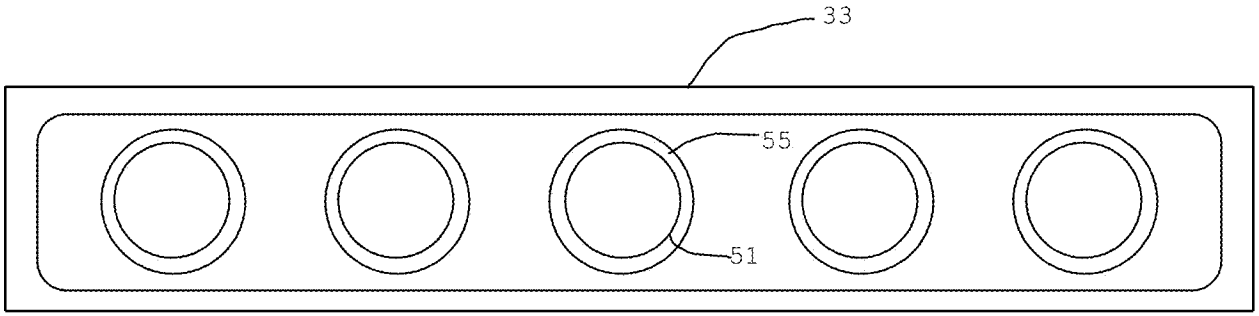
FIG. 9 is a diagram of a back end of the radiation shield revealing holes from which a flame exits the shield to the heat exchanger.

FIG. 8 is a diagram of a front end of shield 33 revealing holes 51. Flame 46 may enter holes 51 at the front end. FIG. 9 is a diagram of a back end of shield 33 revealing holes 51 from which flame 46 exits shield 33. Around each hole 51 is a ridge 55 indented into the material of shield 33 for obtaining a sealed connection to a tube 45 of heat exchanger 34 when shield 33 is pressed and tightened up close to the tubes. Tubes 45 and holes 51 may have other shapes such as an oval, square, triangle, non-symmetrical outlines, and so forth.

Figure 10:
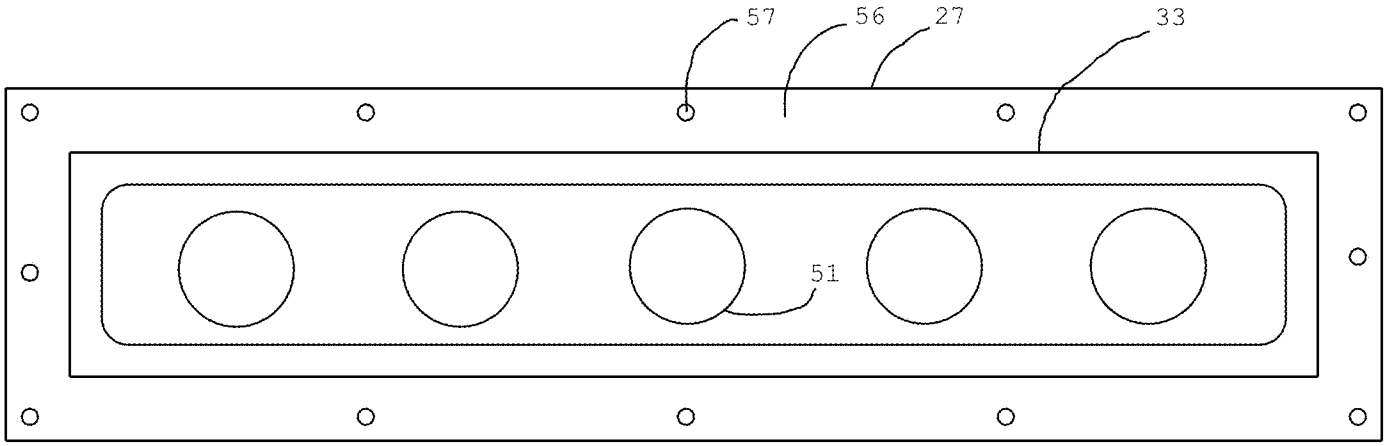
FIG. 10 is a diagram with a front view of the radiation shield inserted partially or entirely into a spacer or combustion chamber.
Figure 11:
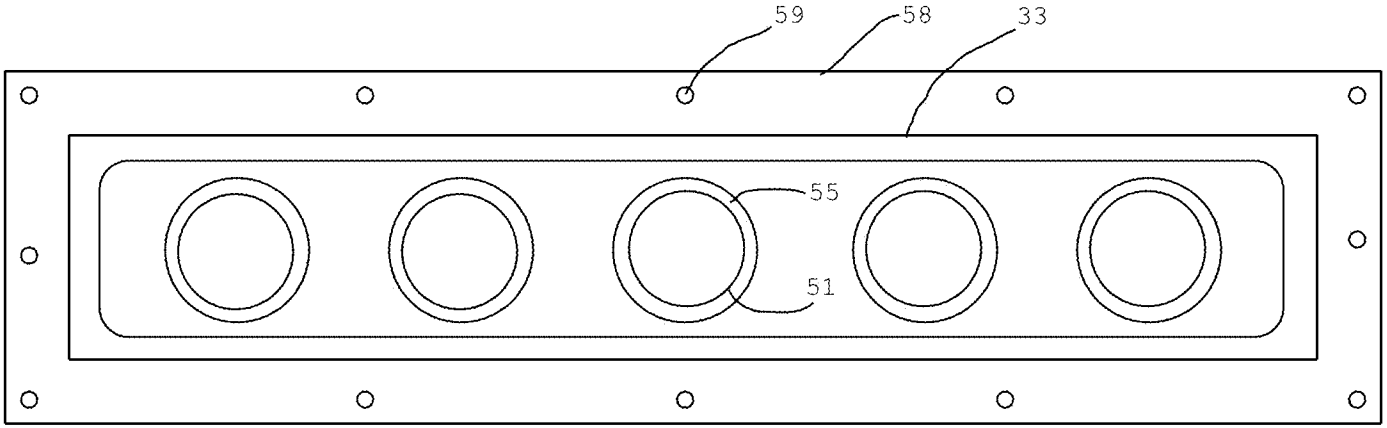
FIG. 11 is a diagram with a back view of the radiation shield situated in the spacer or combustion chamber.

FIG. 10 is a diagram with a front view of shield 33 inserted partially or entirely into spacer 27. An outer edge 56 of spacer 27 may have holes 57 or other items for securing spacer 27 to burner box 25 with screws or other fasteners. Burner head 26 may be situated between space 27 and burner box 25. FIG. 11 is a diagram with a back view of shield 33 situated in spacer 27. An outer edge 58 of spacer 27 may have holes 59 or other items for securing spacer 27 to heat exchanger 34 with screws or other fasteners.

Figure 12:
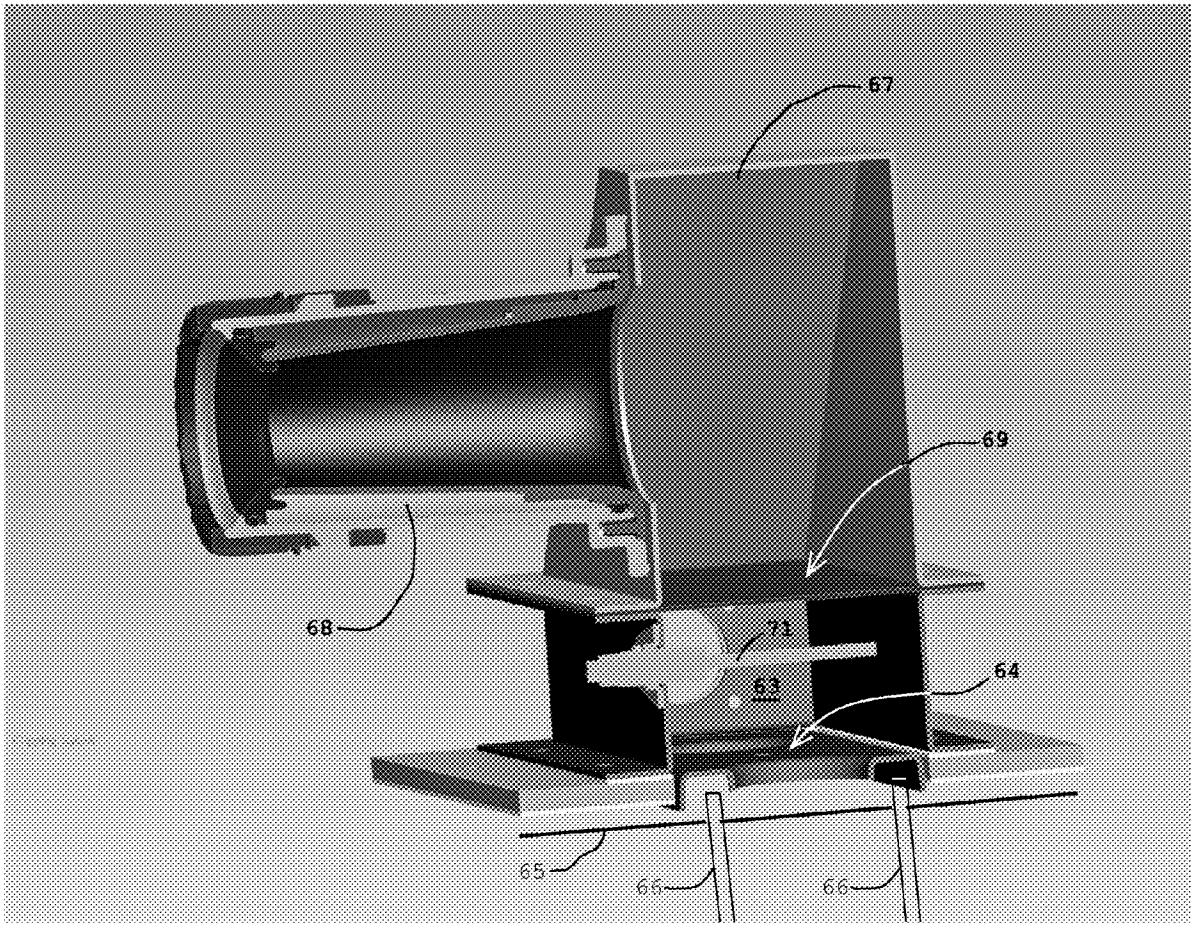
FIG. 12 is a diagram of a combustion chamber having an integrated radiation shield.

FIG. 12 is a diagram of a combustion chamber 63 having an integrated radiation shield 64. A furnace center panel 65 and heat exchanger tubes 66 appear at radiation shield 64. Radiation shield 64 may have a thermal barrier coating. Chamber 63 may be a five-sided vacuum ceramic combustion chamber with integrated radiation shield 64 and a combustion chamber refractory. An insertion of radiation shield 64 in a combustion chamber 63 not previously having the radiation shield may result in a 600 degree F. reduction of temperature on an outside surface of combustion chamber 63 and furnace center panel 65. A burner box 67 may be attached to a burner head 69 which in turn can be attached to combustion chamber 63. A fuel and air mixer 68 may be connected to burner box 67. Item 71 may be a temperature or flame sensor, an igniter, or both.

To recap, an approach for achieving a low-emissions furnace, of a heating, ventilation and air conditioning (HVAC) system, may incorporate moving an air and gas mixture into a manifold, moving the air and gas mixture from the manifold through a burner head and a spacer, igniting the air and gas mixture in the spacer with an igniter into a flame, and moving the flame from the spacer having a radiation shield through one or more output ports of a surface of the radiation shield to one or more sections of a heat exchanger and through the one or more conveyance sections. The radiation shield may incorporate sides on a perimeter of the surface and parallel to sides of the spacer.

An addition of the radiation shield may result in a reduction of at least 200 degrees Fahrenheit (F) on the sides of the spacer. The radiation shield may incorporate a refractory material.

The radiation shield may have a structure that withstands temperatures greater than 1000 degrees F. The radiation shield may incorporate a thermal barrier coating.

The spacer may be a vacuum formed or machined combustion chamber. The radiation shield may be integral to the combustion chamber. A combustion refractory may be integral with the combustion chamber.

The combustion chamber may be a vacuum formed or machined ceramic fiber chamber.

A conveyance section may be a tube that is situated in the heat exchanger.

A furnace burner assembly may incorporate a manifold box having an input port and output port, an air-fuel mixer coupled to the input port, a burner head coupled to the output port, a spacer coupled to the burner head, and a one-to-multiple inshot radiation shield coupled to the spacer. An addition of the radiation shield may reduce an operating temperature of the manifold box, burner head or spacer.

The one-to-multiple inshot radiation shield may incorporate a structure having one input opening and a plurality of output openings. Each opening of the plurality of openings is may be aligned with and coupled to a first end of a conveyance section of a plurality of flame conveyance channels of a heat exchanger.

The assembly may further incorporate an air mover having a port connected to second ends of the plurality of sections. An air tube may be coupled to an intake of the mixer and to an air supply. For instance, an output tube may be coupled to the intake of the mixer and an output of the air mover. The output tube may incorporate a flow limiting orifice situated in series with the output tube. The intake of the mixer may be coupled to a fuel valve and fuel supply port.

A furnace burner system, for a heating, ventilation and air conditioning mechanism (HVAC), may incorporate a burner, a spacer coupled to an output side of the burner, and a radiation shield coupled within the spacer and to an input side of a heat exchanger.

The burner may incorporate a burner box having an input coupled to a fuel mixture source, and a burner head coupled to an output of the burner box and having the output side of the burner.

The radiation shield may be fabricated from a refractory material. The refractory material may maintain its condition from room temperature to least 2300 degrees F.

The radiation shield may incorporate a surface portion having openings that are aligned with conveyance channels situated in the heat exchanger. The radiation shield may have a side on the perimeter of the surface portion and protrude perpendicular to and beyond the surface portion. The conveyance channels may convey heat from the burner head, spacer and radiation shield through the heat exchanger to heat air flowing through the heat exchanger.

The system may further incorporate an igniter situated between the burner head and the radiation shield. The heat exchanger may have a tube or clamshell structure.

The burner box may be funnel-shaped and have a wider portion in a direction toward the burner head and a narrower portion in a direction toward the mixer.

The burner head may incorporate a FeCrAl alloy fiber mat.

The system may further incorporate a blower to provide a below atmospheric pressure in a plurality of sections of the tube or clamshell structure of the heat exchanger to move the gas and air mixture into the burner box and move a flame at the burner head through the radiation shield into the plurality of sections.

An area for each conveyance channel in the radiation shield may range from 0.1 square unit to 2 square units. A width of a surface portion of the radiation shield having an opening for each conveyance channel may range from 0.3 unit to 2 units. A length of the surface portion of the radiation shield having an opening for each conveyance channel may range from 1 unit to 4 units per opening. A thickness of the surface portion of the radiation shield having an opening for each conveyance channel may be equal to or greater than 0.05 unit. A height of sides approximately perpendicular to the surface portion of the radiation shield and situated on a perimeter of the surface portion of the radiation shield may be equal to or greater than 0.05 unit. A thickness of the sides approximately perpendicular to the surface portion of the radiation shield and situated on a perimeter of the surface portion of the radiation shield may be equal to or greater than 0.05 unit.

The present apparatus may relate to technology disclosed in U.S. Pat. No. 6,923,643, issued Aug. 2, 2005, and entitled "Premix Burner for Warm Air Furnace", and in U.S. Pat. No. 6,880,548, issued Apr. 19, 2005, and entitled "Warm Air Furnace with Premix Burner". U.S. Pat. No. 6,923,643, issued Aug. 2, 2005, is hereby incorporated by reference. U.S. Pat. No. 6,880,548, issued Apr. 19, 2005, is hereby incorporated by reference.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A furnace burner system, for a heating, ventilation and air conditioning mechanism (HVAC), comprising:
- a burner;
- a spacer coupled to an output side of the burner; and
- a metal radiation shield disposed inside the spacer and coupled to an input side of a heat exchanger, wherein the radiation shield separates the burner from the heat exchanger.

2. The system of claim 1, wherein:
- the burner comprises:
  - a burner box having an input coupled to a fuel mixture source; and
  - a burner head coupled to an output of the burner box and having the output side of the burner; and
- the radiation shield is stamped or machined metal.

3. The system of claim 2, wherein:
- the radiation shield has a surface portion having openings that are aligned with conveyance channels situated in the heat exchanger;
- the radiation shield has a side on the perimeter of the surface portion and protrudes perpendicular to and beyond the surface portion; and
- the conveyance channels convey heat from the burner head, spacer and radiation shield through the heat exchanger to heat air flowing through the heat exchanger.

4. The system of claim 2, further comprising:
- an igniter situated between the burner head and the radiation shield; and
- wherein the heat exchanger comprises a tube or clamshell structure.

5. The system of claim 2, wherein the burner box is funnel-shaped and has a wider portion in a direction toward the burner head and a narrower portion in a direction toward the mixer.

6. The system of claim 2, wherein the burner head comprises a FeCrAl alloy fiber mat.

7. The system of claim 2, further comprising a blower to provide a below atmospheric pressure in a plurality of sections of the tube or clamshell structure of the heat exchanger to move the gas and air mixture into the burner box and move a flame at the burner head through the radiation shield into the plurality of sections.

8. A furnace burner system for a heating, ventilation and air conditioning mechanism (HVAC), comprising:

a burner comprising a burner box having an input coupled to a fuel mixture source, and a burner head coupled to an output of the burner box and having an output side of the burner;

a spacer coupled to the output side of the burner; and a radiation shield coupled within the spacer and to an input side of a heat exchanger, wherein the radiation shield separates the burner from the heat exchanger, wherein the radiation shield is fabricated from a refractory material; wherein an area for each conveyance channel in the radiation shield ranges from 0.1 square unit to 2 square units;

a width of a surface portion of the radiation shield having an opening for each conveyance channel ranges from 0.3 unit to 2 units;

a length of the surface portion of the radiation shield having an opening for each conveyance channel ranges from 1 unit to 4 units per opening;

a thickness of the surface portion of the radiation shield having an opening for each conveyance channel is equal to or greater than 0.05 unit;

a height of sides approximately perpendicular to the surface portion of the radiation shield and situated on a perimeter of the surface portion of the radiation shield is equal to or greater than 0.05 unit; and a thickness of the sides approximately perpendicular to the surface portion of the radiation shield and situated on a perimeter of the surface portion of the radiation shield is equal to or greater than 0.05 unit.

9. A furnace burner assembly comprising:

a manifold box having an input port and output port;

an air-fuel mixer coupled to the input port;

a burner head coupled to the output port;

a spacer coupled to the burner head;

a one-to-multiple inshot metal radiation shield disposed inside the spacer;

a heat exchanger coupled to the radiation shield; and wherein the burner head is separated from the heat exchanger by the radiation shield, wherein an addition of the radiation shield reduces an operating temperature of the manifold box, burner head or spacer.

10. The assembly of claim 9, wherein:

the one-to-multiple inshot radiation shield comprises a structure having one input opening and a plurality of output openings; and each opening of the plurality of openings is aligned with and coupled to a first end of a conveyance section of a plurality of flame conveyance channels of a heat exchanger.

11. The assembly of claim 10, further comprising:

an air mover having an input connected to second ends of the plurality of sections; and wherein:

an air tube is coupled to an intake of the mixer and to an air supply;

an output tube is coupled to the intake of the mixer and an output of the air mover;

the output tube comprises a flow limiting orifice situated in series with the output tube; and the intake of the mixer is coupled to a fuel valve and fuel supply port.

* * * * *